United States Patent [19]

Sharrock et al.

[11] 4,389,801

[45] Jun. 28, 1983

[54] POCKETS FOR GARMENTS

[75] Inventors: Michael Sharrock, Oxton; Donovan N. Fry; Robert William, both of Skegness, all of England

[73] Assignee: Joel & Aronoff, Inc., Ridgefield, N.J.

[21] Appl. No.: 334,326

[22] Filed: Dec. 24, 1981

[51] Int. Cl.[3] ..... A47G 1/06; G09F 1/10; A44C 3/00; A41D 27/20

[52] U.S. Cl. ..... 40/159; 40/16; 40/1.5; 40/594; 40/586; 2/247

[58] Field of Search ..... 2/247, 248, 249, 250, 2/246, 253; 40/10 R, 152, 594, 159, 16, 586, 10 C, 1.5, 1.6

[56] References Cited

U.S. PATENT DOCUMENTS

| | | | |
|---|---|---|---|
| 1,467,680 | 9/1923 | Oda | 40/617 |
| 2,671,902 | 3/1954 | Grue | 2/247 |
| 2,871,601 | 2/1959 | Warnow | 40/16 |
| 2,986,743 | 6/1961 | Eilen | 40/10 R |
| 3,438,062 | 4/1969 | Dobell | 2/247 |
| 4,266,300 | 5/1981 | Partridge | 2/247 |
| 4,349,920 | 9/1982 | Off | 2/247 |

*Primary Examiner*—Gene Mancene
*Assistant Examiner*—Michael J. Foycik, Jr.
*Attorney, Agent, or Firm*—Gottlieb, Rackman & Reisman

[57] ABSTRACT

A pocket for a garment has a facing sheet of flexible material provided with an adhesive backing and having an opening through which a card or the like can be displayed, and a masking sheet of flexible material provided with a similar opening and attached to the facing sheet in order to mask the adhesive backing in the region around and above the opening in the facing sheet when the pocket is attached to a garment. The portion of the facing sheet around and above the opening does not therefore adhere to the garment and enables a card or the like to be inserted into the pocket.

12 Claims, 2 Drawing Figures

POCKETS FOR GARMENTS

The invention relates to pockets for garments.

In many large establishments work people are provided with overalls or other working garments to protect their normal clothing. There is also a need in many establishments to identify key personnel and problems arise in providing a satisfactory means of doing so without the use of detachable badges or like means which can become separated from garments and lost and without providing permanent printed labels or the like on individual garments which is expensive due to the small quantities required and creates problems in that spare garments are required to enable regular cleaning.

It is an object of the present invention to obviate or mitigate these difficulties.

The invention provides a pocket for a garment comprising a facing sheet of flexible material provided with an adhesive backing and having an opening through which a card or the like can be displayed, and a masking sheet of flexible material attached to the facing sheet in order to mask the adhesive backing in the region around and above said opening when the pocket is attached to a garment whereby the portion of the facing sheet which is around and above the opening in use does not adhere to the garment and enables a card or the like to be inserted into the pocket.

Preferably the facing and masking sheets are formed of textile fabric, the face of the masking sheet adjacent to the back of the facing sheet being coated with adhesive whereby the facing and masking sheets are adhered together when the pocket is attached to the garment.

The adhesive is preferably a heat sensitive adhesive and is selected to withstand repeated contact with dry cleaning fluids and the like used for garment laundering purposes.

Advantageously the two sheets are secured together by stitching along the edge of the pocket which will be uppermost in use. The stitching may advantageously comprise merrowing or other form of embroidered stitching forming a projecting edge which serves to retain an identification card or the like in the pocket in use. The edging may also be coloured for identification or decorative purposes.

An embodiment of the invention will now be described, by way of example only, with reference to the accompanying drawings, in which.

Figure 1:
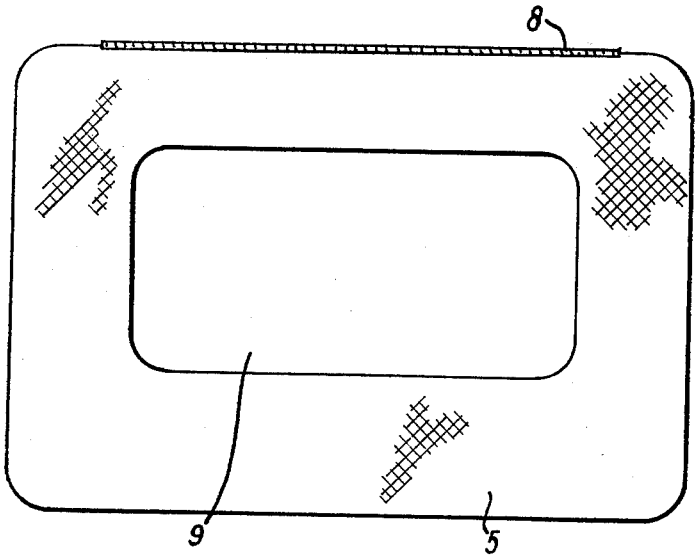
FIG. 1 is a front view of a pocket according to the invention.
Figure 2:
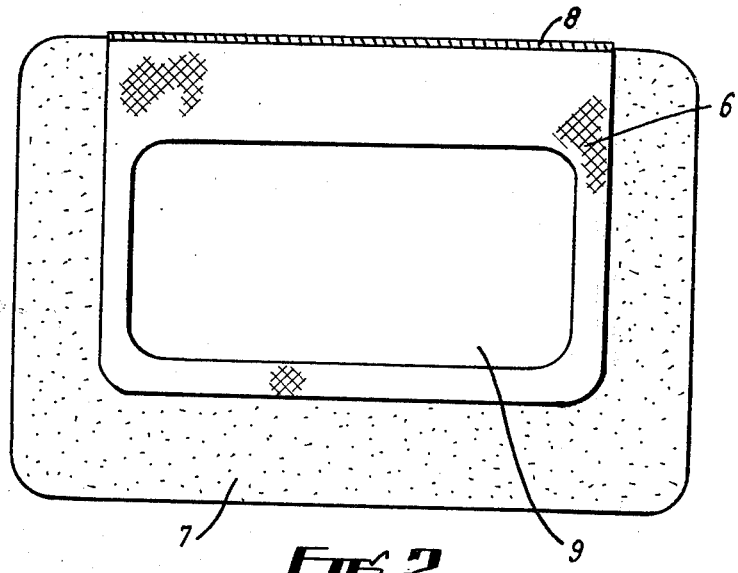
FIG. 2 is a rear view of the pocket shown in FIG. 1.

Referring to the drawings, the pocket comprises a front or facing sheet 5 of flexible textile fabric selected so as to be capable of withstanding repeated laundering and coated on its rear face with a heat-sensitive adhesive compatible with cleaning fluids or the like. A rear or masking sheet 6 of similar fabric is placed behind the sheet 5 and also has one face coated with heat sensitive adhesive. The sheets are arranged so that the adhesive coated faces are adjacent one another, the sheet 6 therefore serving to mask part of the adhesive coated front sheet when viewed from the rear, leaving a margin 7 of adhesive exposed.

The upper edges of the two sheets 5 and 6 are coincident and are secured together by a row of merrowing or other embroidered stitching 8. Both sheets are provided with through openings 9 which are coincident with one another and together form a window through which a card or similar identification means may be viewed when the pocket is fitted to a garment.

The pocket is secured in place on a garment by applying it to the surface of the garment in the desired position with the masking sheet 6 adjacent the surface of the garment. Heat is then applied to the pocket by heat seal equipment or other suitable means, thereby activating the heat-sensitive adhesive around the exposed marginal portion 7 of the facing sheet to secure the pocket to the garment and also securing the facing and masking sheets together. The masking sheet 6 serves to prevent adherence of the facing sheet around the periphery of the opening 9 and in the region extending between the opening 9 and the upper edge 8 of the pocket.

In use of the garment an identification card of appropriate size may be inserted into the pocket from the upper edge 8, the card bearing printed identification data which are then visible through the window 9. The stitched edge 8 forms a ridge or projection extending across the entrance to the pocket and engaging the upper edge of the card so as to retain the card in position during use of the garment. It will be appreciated that the card may be readily removed and replaced by another card when the garment is used by other personnel and the means of identification is therefore temporary only. Moreover when the garment requires laundering the card can be removed and the pocket will withstand repeated laundering due to the fabric and adhesive being selected for this purpose. Since identification is by means of a card inserted into the pocket and not by means of a device clipped to the edge of the pocket, wear of the pocket is reduced, which together with the ability to withstand repeated laundering, increases the effective life of the garment. It will be appreciated also that the stitched edge 8 may act as a means of identification by utilisation of stitching of different colours, patterns or the like.

In producing the pocket, both the facing and masking sheets may be cut as blanks (that is without the windows 9) from the same sheet of adhesive coated fabric. Pairs of facing and masking sheets may then be stitched together at their longitudinal edges by suitable embroidered stitching and thereafter the window 9 may be formed by cutting simultaneously through both sheets. In this way the entire pocket may be constructed from a single sheet of fabric provided with a suitable heat-sensitive adhesive coating on one surface. The pocket once formed may be readily attached to an existing garment thereby avoiding the need to purchase additional garments when introducing identification card systems or when increasing the number of personnel to whom they apply. It is also possible to apply other matter to the front of the facing sheet, for example the name Trade Mark of the organisation concerned.

Various modifications may be made without departing from the invention. For example pockets may be constructed from various different fabrics and in a wide variety of shapes and sizes. The facing and masking sheets may be secured together in some other manner if desired and in some instances both sheets could be formed as a one piece blank and folded on to one another. Separate formation in the manner described above is however preferred as this avoids the use of complex cutting apparatus. Further security could be incorporated by the addition of a metal fastener or zip which would have one portion attached to the garment. The opening of the pocket can then be closed using the zip or fastener.

We claim:

1. A pocket for a garment comprising a facing sheet of flexible material provided with an adhesive backing and having an opening through which a card or the like can be displayed, and a masking sheet of flexible material attached to the facing sheet in order to mask the adhesive backing in the region around and above said opening when the pocket is attached to a garment, whereby the portion of the facing sheet which is around and above the opening in use does not adhere to the garment and enables a card or the like to be inserted into the pocket.

2. A pocket according to claim 1 wherein the face of the masking sheet adjacent to the back of the facing sheet is coated with adhesive whereby the facing and masking sheets are adhered together when the pocket is attached to the garment.

3. A pocket according to claim 1 wherein the facing and masking sheets are formed of textile fabric.

4. A pocket according to claim 1, 2 or 3 wherein said adhesive is a heat sensitive adhesive.

5. A pocket according to claim 1, 2 or 3 wherein said adhesive is selected to withstand repeated contact with dry cleaning fluids used for garment laundering purposes.

6. A pocket according to claim 1 wherein said sheets are secured together by stitching along the edge of the pocket which will be uppermost in use.

7. A pocket according to claim 6 wherein said stitching forms a projecting edge which serves to retain an identification card in the pocket in use.

8. A pocket according to claim 6 or 7 wherein said stitching is coloured for identification purposes.

9. A pocket according to claim 1, 2 or 3 wherein both said sheets are cut from a single sheet of adhesive coated material.

10. A method of constructing a pocket according to claim 1 comprising cutting both said sheets from a single sheet of material, bringing the sheets into juxtaposition one with the other and cutting through the juxtaposed sheets simultaneously to form said openings.

11. A method according to claim 10 wherein said sheets are cut separately from said single sheet of material and are secured together prior to cutting of said openings.

12. A method according to claim 10 wherein said sheets are formed from said single sheet as a one piece blank and are folded upon one another prior to cutting of said openings.

* * * * *